United States Patent [19]

Chandley

[11] Patent Number: 4,858,672

[45] Date of Patent: Aug. 22, 1989

[54] COUNTERGRAVITY CASTING APPARATUS AND METHOD

[75] Inventor: George D. Chandley, Amherst, N.H.

[73] Assignee: General Motors Corporation, Detroit, Mich.

[21] Appl. No.: 198,229

[22] Filed: May 25, 1988

[51] Int. Cl.[4] ..... B22D 18/06

[52] U.S. Cl. ..... 164/63; 164/255

[58] Field of Search ..... 164/61, 62, 63, 65, 164/253, 254, 255, 256, 257, 258

[56] References Cited

U.S. PATENT DOCUMENTS

| | | | |
|---|---|---|---|
| 2,379,401 | 6/1945 | Poulter | 164/63 |
| 2,705,822 | 4/1955 | Vennerholm | 164/6 |
| 2,991,518 | 7/1961 | Schaefer | 164/63 |
| 3,608,617 | 9/1971 | Burke | 164/126 |
| 3,731,726 | 5/1973 | Eberle | 164/7.1 |
| 3,825,058 | 7/1974 | Miura et al. | 164/253 |
| 3,998,264 | 12/1976 | Hocking | 164/133 |
| 4,340,108 | 7/1982 | Chandley et al. | 164/63 |
| 4,606,396 | 8/1986 | Chandley et al. | 164/255 |
| 4,616,691 | 10/1986 | Voss | 164/255 |
| 4,641,703 | 2/1987 | Voss et al. | 164/255 |

FOREIGN PATENT DOCUMENTS

| | | | |
|---|---|---|---|
| 59-232661 | 12/1984 | Japan | 164/63 |

*Primary Examiner*—Richard K. Seidel

*Attorney, Agent, or Firm*—Reising, Ethington, Barnard, Perry & Milton

[57] ABSTRACT

Apparatus for vacuum countergravity casting includes a gas permeable upper mold member and a lower mold member engaged to the upper mold member. A gas impermeable member includes a central portion overlying the upper surface of the upper mold member and in contact therewith at a plurality of spaced apart contact regions disposed across the horizontal dimension of the upper surface and further includes a peripheral portion in sealed relation substantially about the upper mold member. Reduced pressure is applied between the gas impermeable member and the upper mold member to draw molten metal into mold cavities therein when the lower mold member is placed in a molten metal pool. Simultaneously, ambient pressure, such as atmospheric pressure, above the gas impermeable member is transmitted by the contact regions to the upper mold member in opposition to ambient pressure transmitted to the lower mold member to substantially reduce bending stresses in the mold. As a result, thinner molds can be used or molds having a greater ratio of horizontal mold dimension to vertical mold dimension can be used to reduce the amount of mold material used per casting.

53 Claims, 4 Drawing Sheets

COUNTERGRAVITY CASTING APPARATUS AND METHOD

FIELD OF THE INVENTION

This invention relates to the vacuum countergravity casting of metal in a gas permeable, mold and, more particularly, to a method and apparatus for vacuum countergravity casting with reduced bending stresses in the mold to permit use of thinner molds or molds having a greater ratio of horizontal mold dimension to vertical mold dimension with reduced risk of damage to the mold.

BACKGROUND OF THE INVENTION

The vacuum countergravity casting process using a gas permeable mold is described in such prior art patents as the Chandley et al U.S. Pat. No. 4,340,108 issued July 20, 1982 and U.S. Pat. No. 4,606,396 issued Aug. 17,1986. These patents also illustrate apparatus to practice such process.

Typically, the vacuum countergravity casting apparatus includes a mold having a porous, gas permeable upper mold member and a lower mold member secured together, a vacuum chamber around the upper mold member, and means for submerging the bottom of the lower mold member in a pool of molten metal while evacuating the chamber to draw molten metal up into mold cavities in the upper mold member through ingates in the bottom of the lower mold member. As described in aforementioned U.S. Pat. No. 4,340,108, the upper and lower mold members may comprise gas permeable, low temperature, resin-bonded sand mold members which are adhesively secured (glued) together along a common horizontal parting plane. During casting when the mold cavities are evacuated, an external pressure differential is established across the vertical dimension of the bonded sand mold as a result of reduced pressure being applied on the upper mold member and atmospheric pressure being transmitted to the lower mold member through the molten metal.

As prior art workers have attempted to increase mold size to cast a greater number of castings per mold, the horizontal mold dimension has been increased relative to the vertical mold dimension. In particular, the ratio of horizontal mold dimension to vertical dimension has been increased to 7 or 8:1 from a previously used ratio of about 4:1. At the higher dimensional ratios, the mold becomes susceptible to damage as a result of the aforementioned pressure differential across the vertical mold dimension. If the mold is not sufficiently strong, it can deflect or even fail from bending stresses developed in the mold and result in production of defective castings or damaging melt run-out into the casting chamber.

In the past, prior art workers have increased the vertical dimension of the mold concomitant with increases in horizontal mold dimension to increase mold strength. However, increasing the vertical mold dimension adds significantly to the cost and weight of the mold.

Even if the vertical dimension of the mold is increased to this end, prior art workers must hope that the adhesively bonded joint between the upper and lower mold members is strong enough to prevent failure at the joint from the pressure differential thereacross, especially if the vacuum chamber is sealed to the lower mold member.

Furthermore, even for smaller mold sizes having for example dimensional ratios of about 4:1, there is a desire on the part of prior art workers to reduce the vertical mold dimension (mold thickness) relative to the horizontal dimension to lower the cost and weight of such molds.

It is an object of the present invention to provide an improved apparatus and method for vacuum countergravity casting wherein bending stresses developed in the mold are substantially reduced in such a way to permit reduction in the vertical mold dimension relative to horizontal mold dimension and use of thinner molds or molds having a greater horizontal to vertical dimensional ratio with reduced risk of damage to the mold. It is a further object of the invention to provide an improved countergravity casting apparatus and method wherein the upper and lower mold members need not be glued or adhered together.

SUMMARY OF THE INVENTION

The invention comprehends a vacuum countergravity casting apparatus comprising a mold having a porous, gas permeable upper mold member at least in part defining a mold cavity therein and a lower mold member engaged to the upper mold member and having a bottom ingate passage for supplying molten metal to the mold cavity from an underlying molten metal pool, and a housing defining a chamber for confronting the gas permeable, upper mold member and having a septum in the chamber for contacting the upper mold member to transmit ambient pressure thereto in opposition to ambient pressure transmitted to the lower mold member when subambient pressure is established between the septum and the upper mold member to draw molten metal into the mold cavity. Bending stresses in the mold are substantially reduced by transmitting opposing ambient pressure to the upper mold member and lower mold member. The septum may comprise a gas permeable or gas impermeable member.

The invention further contemplates a vacuum countergravity casting apparatus comprising a gas permeable upper mold member having an upper surface and at least in part defining a mold cavity therein, a lower mold member engaged to the upper mold member and having a bottom ingate passage to supply molten metal to the mold cavity when the bottom of the lower mold member is positioned in molten metal, a gas impermeable member having a portion overlying the upper surface of the upper mold member in contact therewith at a plurality of spaced apart contact regions distributed across the upper surface and having a peripheral portion, sealing means disposed between the peripheral portion of the gas impermeable member and the mold, means for providing ambient pressure above the gas impermeable member, and means for providing relatively reduced (i.e., subambient) pressure between the gas impermeable member and upper surface. The gas impermeable member confines the reduced pressure therebeneath to the first mold member and mold cavity to effect filling of the mold cavity with molten metal and transmits through the plurality of spaced apart contact regions ambient pressure, such as atmospheric pressure, to the upper mold member in opposition to ambient pressure transmitted to the lower mold member to substantially reduce the bending stresses developed in the mold when subambient pressure is established in the mold cavity. The contact regions distribute ambient pressure across the horizontal dimension of the upper surface while allowing reduced pressure to extend sufficiently thereacross to evacuate the mold cavities.

In one embodiment of the apparatus of the invention, the peripheral portion of the gas impermeable member is in sealed relation to the wall of a housing defining a chamber confronting the upper mold member. In another embodiment, the peripheral portion is in sealed relation to the mold itself, either the upper or lower mold member. When the peripheral portion of the gas impermeable member is in sealed relation to the lower mold member, the upper and lower mold members may be held together solely by ambient pressure (i.e., without adhesive) when reduced pressure is applied beneath the gas impermeable member to the upper mold member and mold cavity.

In a preferred embodiment of the apparatus of the invention, a plurality of spaced apart standoffs are disposed between the gas impermeable member and upper surface of the upper mold member to provide the plurality of spaced apart contact regions therebetween. A vacuum conduit preferably is connected to the gas impermeable member to provide reduced pressure therebeneath in the space around the standoffs. The gas impermeable member may be flexible or include flexible portions to allow the standoffs to intimately contact the gas impermeable member and upper mold member.

The invention further contemplates a vacuum countergravity casting apparatus comprising a housing that defines a vacuum chamber confronting the gas permeable upper mold member and that includes a relatively movable upper portion and lower portion with a rigid, gas permeable septum secured to the upper portion of the housing and overlying the upper mold member for contacting the upper mold member to transmit ambient pressure on the housing to the upper mold member, means for sealing the mold to the lower portion of the housing, and means for providing subambient pressure in the vacuum chamber to evacuate a mold cavity at least partially defined in the upper mold member through the gas permeable septum when the lower mold member is immersed in a molten metal pool. When subambient pressure is provided in the vacuum chamber, the mold and the housing are relatively moved toward one another, as permitted by relative movement between the upper and lower portions of the housing, so as to contact the septum and upper mold member for transmitting ambient pressure on the housing to the upper mold member in opposition to ambient pressure transmitted to the lower mold member, whereby bending stresses in the mold are minimized and the upper mold member and lower mold member are held together by the ambient pressure without adhesive.

The invention also contemplates a method for vacuum countergravity casting conducted in such a way to minimize bending stresses in the mold and preferably to hold the upper mold member and lower mold member together without adhesive.

The invention further contemplates a method and apparatus for vacuum countergravity wherein the gas impermeable member is releasably engaged to and carries the peripheral wall of the vacuum chamber relative to a mold and wherein the gas impermeable member and the peripheral wall of the vacuum chamber are disengageable and relatively movable when the peripheral wall contacts the mold to facilitate sealing of the peripheral wall to the mold.

BRIEF DESCRIPTION OF THE DRAWINGS

The invention may be understood better when considered in light of the following detailed description of certain specific embodiments thereof which are given hereafter in conjunction with the following drawings.

BEST MODE FOR PRACTICING THE INVENTION

Figure 1:
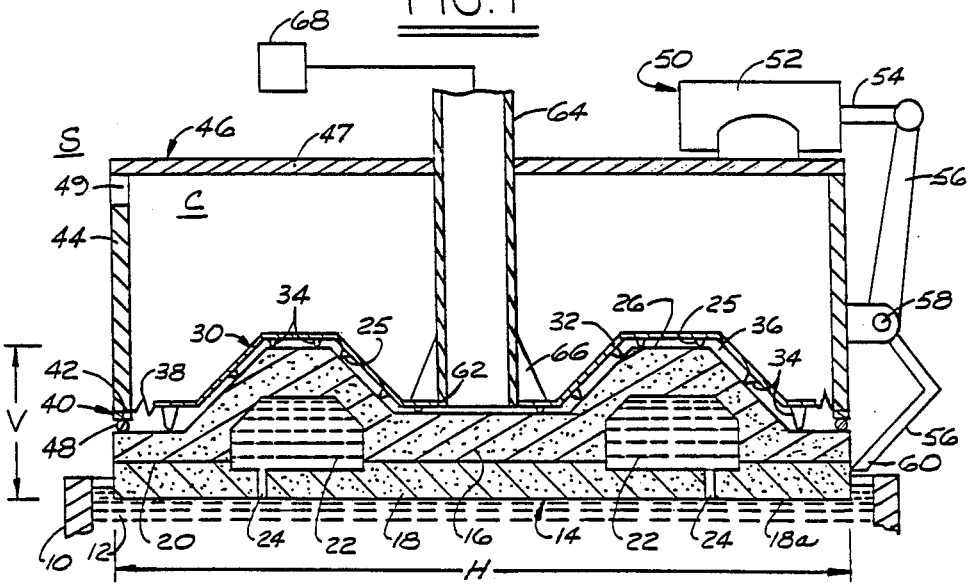
FIGS. 1, 2, 5, 6, 7, 8 and 9 are side sectional views through different embodiments of a vacuum countergravity metal casting apparatus in accordance with the present invention.

FIG. 1 illustrates a vacuum countergravity casting apparatus in accordance with one embodiment of the invention. The apparatus includes a container 10 of molten metal 12 to be drawn up into the mold 14. The mold 14 includes a porous, gas permeable upper mold member 16 and a lower mold member 18, which may be gas permeable or impermeable. The upper and lower mold members 16, 18 may be adhesively or otherwise secured together along juxtaposed surfaces that define a parting line or plane 20 to provide a unitary mold. Defined between the upper and lower mold members are a plurality of mold cavities 22 (two shown) to be filled with molten metal from container 10 through ingate passages 24 on the underside or bottom 18*a* of lower mold member 18 when the mold cavities are evacuated with bottom 18*a* submerged in the molten metal. To this end, each ingate passage 24 extends from the bottom of the lower mold member to a respective mold cavity 22 that is formed at least in part into the upper mold member. The number, size and spacing of mold cavities 22 and ingate passages 24 will vary with the type of part to be cast and the particular metal to be cast as explained in U.S. Pat. No. 4,340,108, the teachings of which are incorporated herein by reference.

Upper and lower mold members 16, 18 can be made of resin-bonded sand in accordance with known mold practice wherein a mixture of sand or equivalent particles and bonding material is formed to shape and cured or hardened against a contoured metal pattern (not shown) having the desired complementary contour or profile for the parting surfaces and the mold cavities in the upper and lower mold members. The bonding material may comprise inorganic or organic thermal or chemical setting plastic resin or equivalent bonding material. The bonding material is usually present in minor percentage, such as less than about 5% by weight of the mixture. After curing or hardening, the resin-bonded sand mold members 16,18 may be adhesively secured together along parting plane 20 to form mold 14. The invention is advantageously used with low-temperature, resin-bonded sand molds.

However, the invention is not limited to resin-bonded sand molds and may find use with other types of nonmetallic refractory molds; e.g., investment molds of the high temperature ceramic type known in the art, such as investment molds made from alumina, zircon, fused quartz and like ceramic particulate and binder, such as colloidal silica. As used herein including the claims, a ceramic mold shall include a mold of the bonded sand type, high temperature ceramic type or other mold types made of non-metallic refractory materials.

Upper mold member 16 and lower mold member 18 may be made of the same or different ceramic composition.

In any case, upper mold member is made of a porous, gas permeable material which permits gases to be withdrawn from mold cavities 22 when a relative vacuum is applied to upper surface 26 of the upper mold member.

Mold 14 may be made in Various exterior shapes (e.g., circular, rectangular, etc.). A particularly convenient and efficient mold is one in which upper and lower mold members 16,18 are generally cylindrical discs in shape. Such a mold is shown in FIG. 1 as having a horizontal mold dimension (mold diameter) H and a vertical mold dimension (mold thickness) V.

As shown in FIG. 1, upper surface 26 of the upper mold member typically is irregular in contour since it is formed of generally uniform thickness mold material applied onto the irregular contour of a pattern to reduce the weight of mold material required. The pattern is removed after mold formation in accordance with known practice. Bottom 18*a* of the lower mold member may also have an irregular contour for this same reason, although a flat horizontal bottom is preferred.

Figure 4:
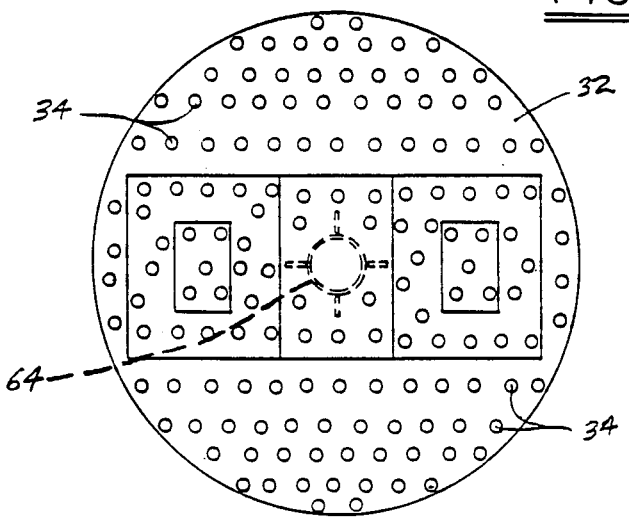
FIG. 4 is a bottom elevation of the central portion of the sheet metal gas impermeable member showing the dispersed pattern of standoffs thereacross.

In FIG. 1, gas impermeable sheet metal member 30 is shown overlying and following the contour of upper surface 26 of the upper mold member. Member 30 is a septum which divides the chamber C formed by the housing 46 into upper and lower parts and includes a central portion 32 having a plurality of standoffs or projections 34 spaced apart on the inner or lower side thereof facing upper surface 26 and extending toward and into engagement with the upper surface to provide a plurality of spaced apart contact regions 25 between the central portion 32 and upper surface 26. As shown in FIG. 4, the standoffs 34 are disposed in a dispersed pattern across portion 32 to effect contact with upper surface 26 at a plurality of spaced apart contact regions distributed across its horizontal dimension or area. In this way, the standoffs distribute ambient pressure applied on the gas impermeable member across the upper surface 26 and form a space 36 between the gas impermeable member and upper surface 26. Space 36 extends to peripheral portion 40 of the gas impermeable member to allow reduced pressure to sufficiently confront upper surface 26 for evacuation of mold cavities 22.

Although a particular dispersed pattern of standoffs is shown in FIG. 4, other patterns can be used to achieve the same end. Moreover, the standoffs may have configurations other than the generally conical cross-sectional shape shown.

Peripheral portion 40 is placed in sealed relation to the upper surface 26 around its periphery. In particular, the peripheral portion includes a peripheral annular (cylindrical) rim 42. Rim 42 preferably is secured to the bottom end of depending annular (cylindrical) wall 44 of metal housing or box 46. Sealing means in the form of an annular sealing member 48 is disposed between peripheral rim 42 and upper surface 26 and may be joined to one of them. Alternatively the peripheral portion of the gas impermeable member may be sealed to the wall 44 higher up in the housing 46 (e.g., see FIG. 6.).

Figure 6:
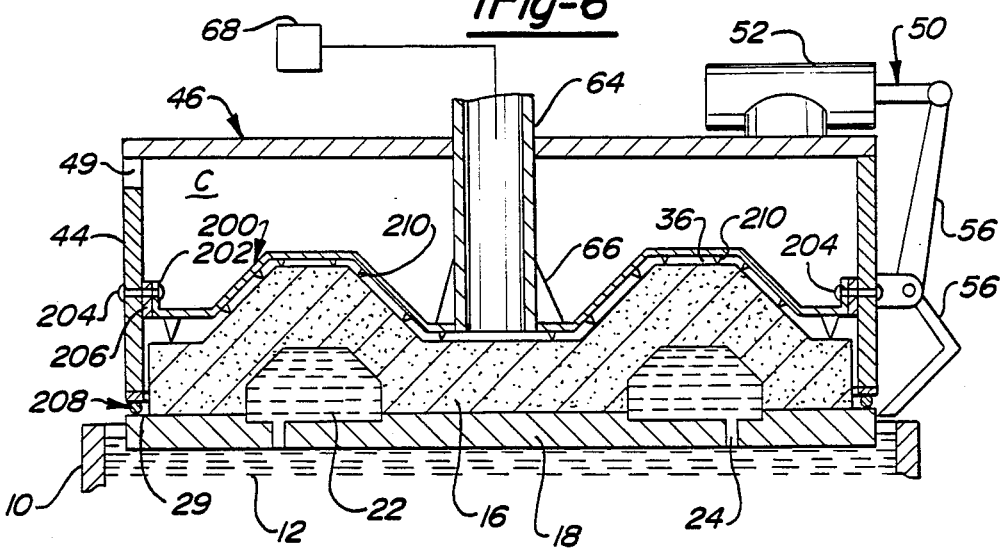

The gas impermeable member is thus peripherally sealed substantially about the upper mold member in FIGS. 1 and 6 such that space 36 confronts the upper mold member.

Housing or box 46 and lower mold member 18 may be engaged together by multiple conventional clamps 50 (only one shown) spaced around the circumference or periphery of the mold. Each clamp 50 includes a fluid cylinder 52 mounted on housing 46, a plunger 54 actuated by the cylinder and a clamp arm 56 pivotable about pin 58. Extension of the plunger 54 causes clamp end 60 on the clamp arm to grip lower mold member 18 to engage the housing 46 and the lower mold member together to effect sealing action between upper surface 26, sealing member 48 and rim 42.

Housing 46 is supported from a known mechanism for advancing the housing and mold clamped thereto toward the molten metal to submerge bottom 18*a* therein and away from the molten metal after casting.

Rim 42 of the gas impermeable member is connected to central portion 32 by annular flexible portion 38 that allows the standoffs 34 of the central portion to intimately contact upper surface 26 when the space 36 and mold cavities 22 are evacuated.

Central portion 32 of the gas impermeable member includes an opening 62 that sealingly receives an open end of vacuum pipe or conduit 64. The vacuum pipe is joined to central portion 32 by multiple stiffening ribs 66 welded or otherwise attached to the vacuum pipe and to the central portion.

The opposite end of the vacuum pipe extends through the top wall 47 of housing 46 and is connected to a source of vacuum or reduced pressure; e.g., a conventional vacuum pump 68. The vacuum pipe can be attached to and supported by the top wall 47 of the housing.

Housing 46 is provided with one or more apertures 49 (one shown) connecting the interior chamber C of the housing above the gas impermeable member with ambient space S surrounding the housing. Molten metal in container 10 also is exposed to space S. Space S may be defined by another external housing (not shown) enclosing the vacuum countergravity casting apparatus illustrated or may simply constitute unenclosed ambient space surrounding the casting apparatus.

Space S and chamber C may include a natural atmosphere providing atmospheric pressure on the gas impermeable member and molten metal or an artificial atmosphere, such as a protective inert gas atmosphere, providing an artificial ambient pressure on the gas impermeable member and molten metal. In FIG. 1, chamber C and space S will have a common atmosphere exerting an equal ambient pressure on the gas impermeable member and the molten metal in container 10.

However, those skilled in the art will appreciate that chamber C and space S may have atmospheres differing from one another in composition or other properties. A relative vacuum may also be employed in both chamber C and space S prior to filling the mold cavities to effect degassing of the casting apparatus and molten metal. Chamber C and space S can then be backfilled with a protective artificial atmosphere following degassing to carry out the countergravity casting process.

In operation with the mold 14, gas impermeable member 30 and housing 46 cooperatively engaged as shown in FIG. 1 and with the entire bottom 18*a* of the lower mold member submerged in the pool of molten metal in container 10, the vacuum pump is actuated to provide reduced pressure in space 36 between the gas impermeable member and upper surface 26 and thus in mold cavities 22 to draw molten metal into mold cavities 22 through ingate passages 24. Concurrently, external ambient (atmospheric or artificial) pressure in chamber C bears against the outer or upper side of the gas impermeable member. Since standoffs 34 are in a dispersed pattern across the central portion 32, ambient pressure above the gas impermeable member is transmitted to the upper mold member at numerous contact regions 25 distributed across the horizontal dimension or area of upper surface 26 in opposition to ambient pressure transmitted to bottom 18*a* of the lower mold member 18 through the molten metal. Ambient pressure on the top and bottom of the mold 14 thereby is substantially balanced to substantially eliminate bending stresses in the mold. As a result, for a mold of given horizontal mold dimension and vertical mold dimension, the potential of damage to the mold from unbalanced external pressure across the vertical mold dimension is substantially reduced. As a further result, the vertical mold dimension V for a given mold size can be reduced to provide a lower cost mold or the horizontal mold dimension H can be increased relative to the vertical mold dimension V to cast more parts per mold. In particular, the invention permits use of molds whose H/V ratio is about 7:1 and greater so that more castings can be produced from a single larger size mold without increased use of mold material per casting.

With the housing and mold withdrawn from the molten metal after casting, clamps 50 are released from lower mold member 18 to allow separation of the mold from the housing.

Figure 2:
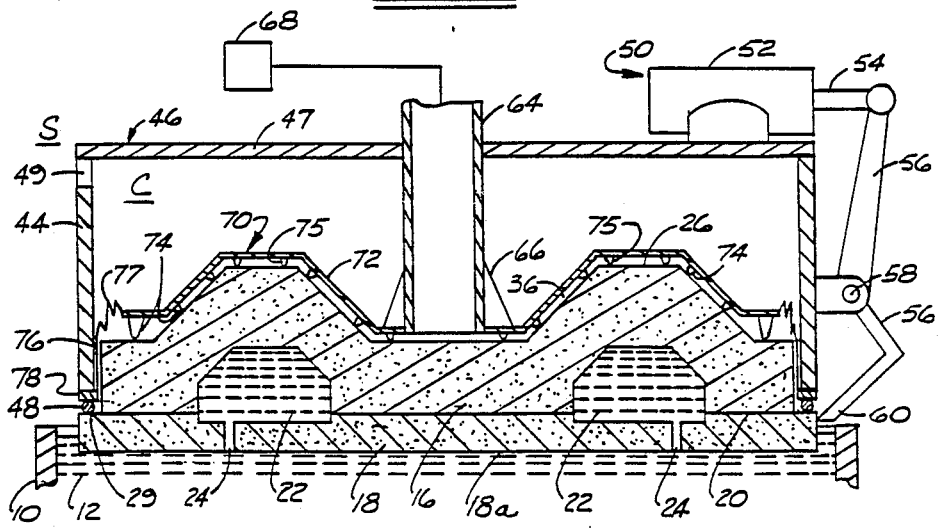

FIG. 2 illustrates another embodiment of the invention similar to that shown in FIG. 1 with the exception that a modified gas impermeable member or septum 70 is used to effect sealed relation with the lower mold member, not the upper mold member. In FIG. 2, like reference numerals are used for like features or components of FIG. 1 and different reference numerals are used only when the Figures differ from one another.

In particular, in FIG. 2, modified gas impermeable member 70 includes central portion 72 having a plurality of spaced apart standoffs 74 for providing a plurality of spaced apart contact regions 75 across the horizontal dimension of upper surface 26 of the upper mold member 16. The gas impermeable member further includes depending annular (cylindrical) peripheral sleeve portion 76 connected to central portion 72 by annular flexible portion 77. Sleeve portion 76 includes peripheral annular rim 78 that preferably is attached to the bottom end of depending annular wall 44 of housing 46. Rim 78 is placed in sealed relation against annular sealing member 48. Sealing member 48 in turn is in sealed relation to peripheral shoulder 29 of lower mold member 18 whose diameter is selected to expose shoulder 29 on the lower mold member. Housing 46 and the lower mold member are clamped together by clamps 50 (only one shown) to effect sealing action between shoulder 29, sealing member 48 and rim 78. The gas impermeable member is thereby disposed in sealed relation substantially about the upper mold member. Sleeve portion 76 is relatively rigid to withstand the force applied to effect sealing action.

When reduced pressure is provided in space 36 by actuation of vacuum pump 68, the upper mold member and lower mold member will be pressed and engaged together by ambient pressure transmitted and distributed onto the upper mold member by standoffs 74 and by ambient pressure transmitted to the lower mold member by way of the molten metal. As a result, it is possible to eliminate the adhesive bond between the upper and lower mold members at the parting line or plane 20 so long as reduced pressure is maintained in space 36 during mold advancement to the molten metal container, mold filling and mold withdrawal from the container. In other respects, operation of the casting apparatus of FIG. 2 as well as other attendant advantages are the same as those described for FIG. 1. The upper and lower mold members of FIG. 1 likewise are pressed together by ambient pressure across those sections of the upper and lower mold members free of mold cavities.

In some situations, it may be desirable to size the horizontal dimension of the central portion 32 of the gas impermeable member 30 in relation to the horizontal dimension of annular wall 44 of the housing 46 to create a net upward force from ambient pressure to enable the mold to be held against the housing 46 without the need for clamps 50. This technique could be practiced for example on the embodiment of FIG. 6 with clamps 50 being removed.

Figure 3:
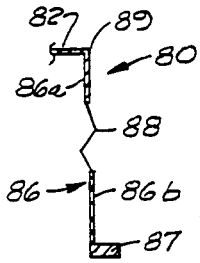
FIG. 3 is a partial sectional view of a modified gas impermeable member that could be used alternately in FIG. 2.

FIG. 3 illustrates a gas impermeable member 80 different from that of the FIG. 2 in that depending annular peripheral sleeve portion 86 includes flexible portion 88 at an intermediate location thereon. In particular, sleeve portion 86 includes a rigid upper cylindrical portion 86*a* connected to lower rigid cylindrical portion 86*b* by flexible portion 88. Lower portion 86*b* includes annular peripheral rim 87. A relatively rigid L-shaped corner 89 is thus provided between central portion 82 and depending annular sleeve portion 86. Flexible portion 88 functions in a similar manner as flexible portion 77 of the embodiment of FIG. 2 to allow a plurality of spaced apart standoffs (not shown) on central portion 82 to intimately contact the upper surface of the upper mold member.

Figure 5:
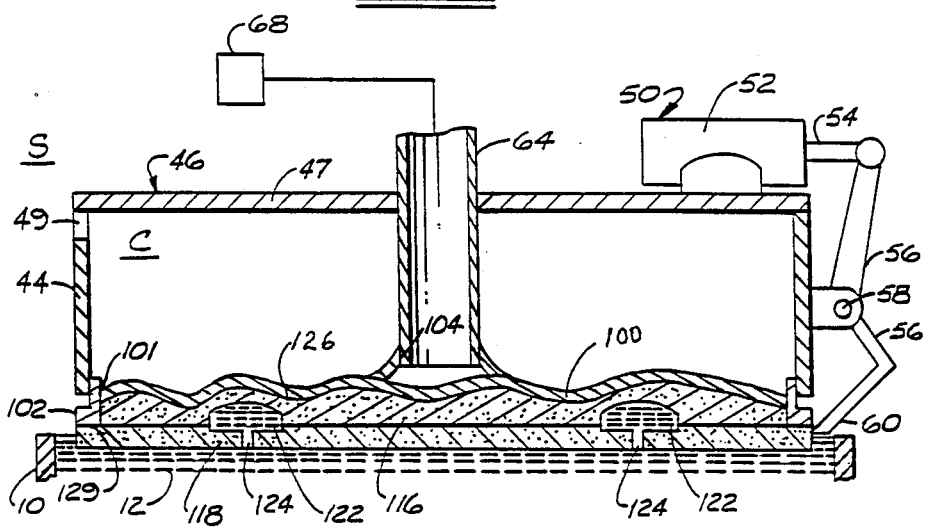

A further embodiment of the vacuum countergravity casting apparatus of the invention is illustrated in FIG. 5. As before, like reference numerals are used for like features or components of previous Figures while different reference numerals are used for different components. In this embodiment, a flexible gas impermeable membrane member 100 is positioned in housing 46 in overlying relation on upper surface 126 of upper mold member 116. The peripheral portion 101 of the gas impermeable member includes annular peripheral sealing rim 102 which may be integral with or sealingly attached to the peripheral portion. Rim 102 in turn is attached to the inner periphery of annular (cylindrical) depending wall 44 of housing 46 as shown with bottom portion of the rim 102 extending below the bottom end of wall 44 to sealingly engage annular peripheral shoulder 129 of lower mold member 118 when housing 46 and lower mold member 118 are clamped together by clamps 50 (only one shown). Sealing rim 102 thus constitutes sealing means disposed between the peripheral portion of the gas impermeable member and peripheral shoulder 129 of the lower mold member.

The gas impermeable membrane 100 includes a central opening 104 receiving vacuum pipe 64 and is sealingly attached to the vacuum pipe around the central opening so that reduced pressure can be established between the gas impermeable membrane and upper surface 126.

The flexible gas impermeable membrane may be made of silicone rubber or other flexible non-metallic material and may be pre-shaped to conform approximately to upper surface 126 or it may be in initial flat sheet form and have sufficient flexibility to conform to upper surface 126 by application of ambient pressure thereon when the mold cavities 122 are evacuated. Even though the gas impermeable membrane is pressed in contact against upper surface 126 by ambient pressure, the relatively high surface roughness of the upper surface 126 in effect provides a plurality of standoffs dispersed across the lateral or horizontal area thereof to establish a plurality of spaced apart contact regions between the upper surface and the gas impermeable membrane. As a result, there are spaces between the gas impermeable membrane and upper surface 126 through which the vacuum can extend toward the peripheral sealing rim 102 across upper surface 126 to evacuate mold cavities 122.

When a vacuum is drawn through pipe 64 to draw molten through ingate passages 124 into the cavities 122, ambient pressure is applied to the outer side of the membrane and this pressure is transmitted and distributed onto upper surface 126 in opposition to ambient pressure transmitted to lower mold member 118 through the molten metal, thereby substantially balancing external pressure on the top and bottom of the mold to significantly reduce or eliminate external pressure differential across the vertical mold dimension.

Application of reduced pressure between the gas impermeable membrane and upper mold member to evacuate the mold cavities will also allow ambient pressure on the upper and lower mold member to hold them together in the same manner as described for FIG. 2.

Still another embodiment of the invention is illustrated in FIG. 6 where like reference numerals are used for like features or components of previous Figures while different reference numerals are used for different components In FIG. 6, the gas impermeable member 200, which may be a sheet metal or flexible member as described hereinabove, is sealingly attached to the inner periphery of gas impermeable housing wall 44 above the upper mold member 16. To this end, the gas impermeable member includes an annular peripheral lip portion 202 that is attached to the wall 44 by a plurality of rivets 204 (two shown) or other suitable fastening means with an annular sealing gasket 206 disposed between peripheral lip portion 202 and the wall such that a reduced pressure can be maintained in the space 36 between the gas impermeable member and upper mold member and around a plurality of standoffs 210 therebetween.

Another annular sealing gasket 208 is positioned between the annular bottom end of wall 44 and the peripheral shoulder 29 of the lower mold member 18 to this same end.

In FIG. 6, sealing gasket 206, sealing gasket 208 and the portion of wall 44 between the gaskets constitute sealing means disposed between the peripheral portion 202 of the gas impermeable member and the lower mold member to peripherally seal peripheral portion 202 to the mold.

In other respects, operation of the casting apparatus of FIG. 6 as well as attendant advantages are the same as those described above for the other embodiments.

Figure 7:
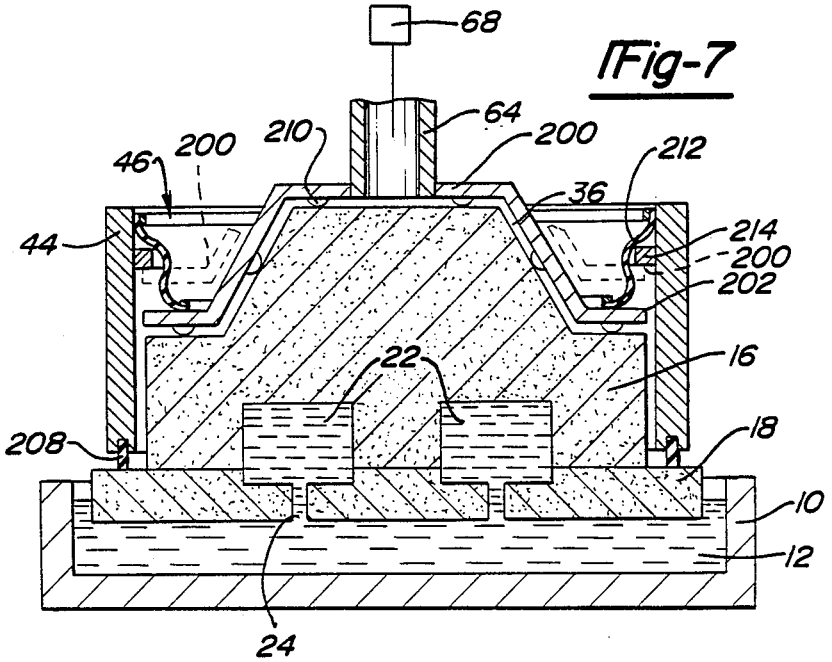

A further embodiment of the invention is illustrated in FIG. 7 where like reference numerals are used for like features or components of previous Figures while different reference numerals are used for different components.

The embodiment of FIG. 7 differs from that of FIG. 6 primarily in that the housing 46 includes the gas impermeable member 200 sealingly secured to the inner periphery of the gas impermeable wall 44 by an annular, flexible, sealing connector member 212 to allow relative movement between the gas impermeable member 200 and the peripheral wall 44. As is apparent, the peripheral wall 44 is open at the upper end thereof and not closed by a top wall. The peripheral wall 44 includes an inwardly projecting annular stop member 214 secured on the inner periphery thereof above the gas permeable member 200.

A vacuum conduit 64 is sealingly attached to the gas impermeable member 200 to evacuate the space 36 between the gas impermeable member 200 and the upper mold member 16. The vacuum conduit 64 (or the gas impermeable member 200 itself) is connected to a mechanism (not shown) for raising and lowering the housing 46 relative to a molten metal pool. The stop member 214 is positioned to be engaged and carried by the peripheral portion 202 of the gas impermeable member 200 during relative movement between the gas impermeable member and the mold 14. For example, the gas impermeable member 200 is moved initially toward the mold 14 with the stop member 214 of the peripheral wall 44 engaged on the gas impermeable member 200 (shown in phantom engaged to the peripheral wall 44). The gas impermeable member 200 with the peripheral wall 44 engaged thereon is moved toward the mold 14 until the seal 208 of the peripheral wall 44 sealingly engages the lower mold member 18. Thereafter, the gas impermeable member 200 continues to move downwardly, disengaging from the peripheral wall 44, until it contacts the upper mold member 16, as shown in FIG. 7. This relative movement between the peripheral wall 44 and the gas impermeable member 200 facilitates and enhances sealing engagement between the seal 208 of the peripheral wall 44 and the upper mold member 16. With the peripheral wall 44 sealed to the lower mold member 18 and the gas impermeable member 200 contacting the upper mold member 16, the lower mold portion 18 is immersed in the molten metal pool and the space 36 is evacuated by conduit 64 to urge molten metal into the mold cavities 22. When the space 36 is evacuated, the upper and lower mold members 16,18 are held together by ambient pressure and bending stresses in the mold 14 are minimized. Either the gas impermeable member 200 or the mold 14 or both can be moved in this embodiment of the invention to engage and disengage the housing 46 and the mold 14.

After casting, the mold 14 is withdrawn from the molten metal pool as described hereinabove for the other embodiments. The gas impermeable member 200 and the peripheral wall 40 are then removed from the mold 14 by establishing ambient pressure in the space 36 and raising the gas impermeable member 200 away from the upper mold member 16. Initially, the gas impermeable member moves independently of the peripheral wall 44 to disengage itself from the upper mold member 16. Eventually as it is raised, the gas impermeable member 200 engages and carries the peripheral wall 44 with it (see phantom lines in FIG. 7) to disengage the peripheral wall 44 from sealing engagement with the lower mold member 18.

Figure 8:
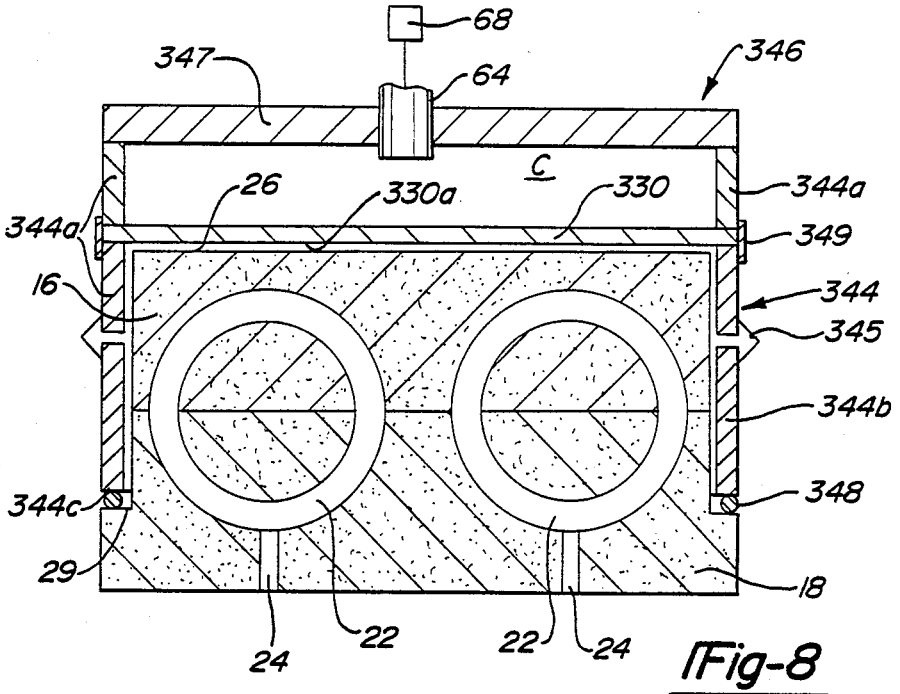
Figure 9:
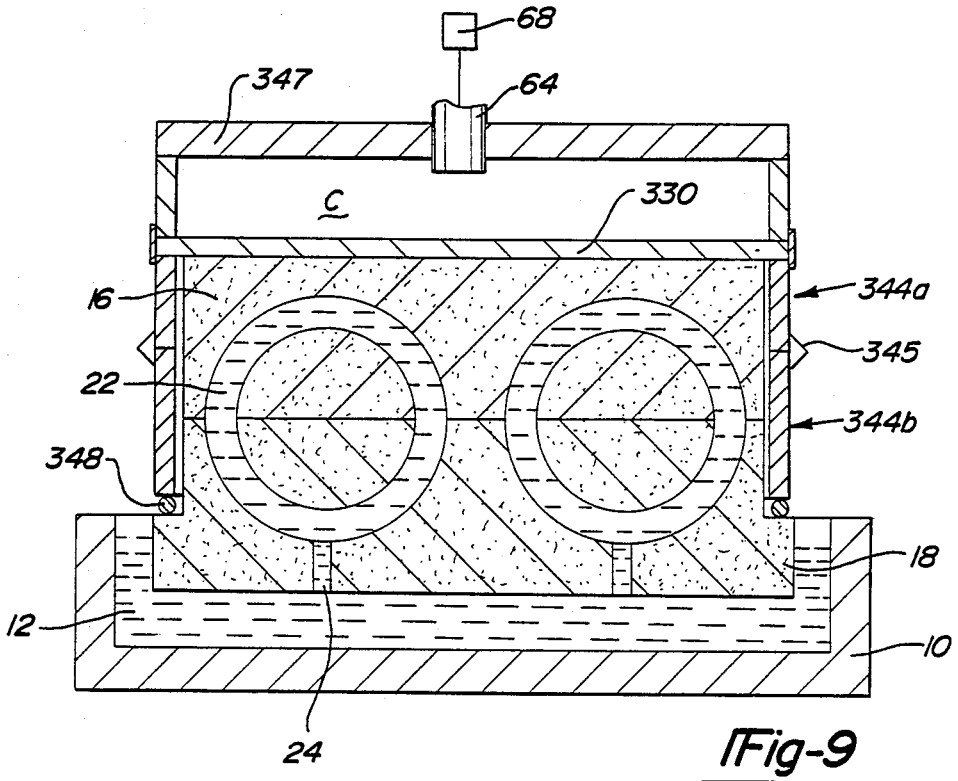

FIGS. 8–9 illustrate still another embodiment of the invention different from the above-described embodiments in that the housing 346 includes a gas permeable septum 330 (e.g., a rigid, porous plate) fastened to the gas impermeable peripheral wall 344 of the housing in overlying relationship to the upper surface 26 of the upper mold member 16. The top wall 347 and the peripheral wall 344 of the housing form a vacuum chamber C in which the gas permeable septum 330 is disposed to divide the chamber C into upper and lower parts.

The septum 330 is fastened between segments of an upper portion 344*a* of the peripheral wall 344. An annular, seal 349 is secured to the upper portion 344*a* of the peripheral wall to seal the outside periphery of the gas permeable septum 330. The upper portion 344*a* is connected to a lower portion 344*b* of the peripheral wall 344 by an annular flexible, joint 345 sealingly attached to the outer peripheries of the upper and lower portions 344*a*, 344*b*. In this way, the upper and lower portions 344*a*,344*b* of the peripheral wall are movable relative to one another.

The lower portion 344*b* of the peripheral wall includes a bottom lip 344*c* having an annular, sealing gasket 348 thereon for sealing engagement with an upwardly facing shoulder 29 on the lower mold member 18.

When the vacuum chamber C is evacuated, ambient pressure on the housing 346 and ambient pressure on the lower mold member 18 act in opposition to one another to effect relative movement between the housing 346 and the mold 14 toward one another until the upper surface 26 of the upper mold member 16 and the lower surface 330*a* of the septum 330 come into contact. During this relative movement, the upper and lower portions 344*a*, 344*b* move relative to one another to compress the peripheral wall 44 (i.e., shorten its length); see FIG. 9. The flexible joint 345 accommodates such relative movement while providing a vacuum sealing function.

As is apparent, the ambient pressure on the housing 346 is transmitted to the rigid, gas permeable septum 330 through the upper portion 344*a* of the peripheral wall 344. The septum 330 in turn transmits this ambient pressure to the upper mold member 16 through the plurality of contact regions provided therebetween as a result of roughness of the upper surface 26 of the upper mold member 16. The ambient pressure transmitted to the upper mold member 16 is in opposition to ambient pressure transmitted to the lower mold member 18 to minimize bending stresses in the mold 14 as in the above-described embodiments.

As is also apparent, the vacuum drawn in the vacuum chamber C will also cause the upper and lower mold members 16,18 to be pressed and held together by the opposing ambient pressure exerted thereon, eliminating the need to glue the upper and lower mold members 16,18 together. This same vacuum is used to evacuate the annular mold cavities 22 through the gas permeable upper mold member 16 and the gas permeable septum 330 to draw molten metal 12 from the pool through ingate passages 24 into the mold cavities 22 to effect casting.

While the invention has been described in terms of specific embodiments thereof, it is not intended to be limited thereto but rather only to the extent set forth hereafter in the following claims.

I claim:

1. An apparatus for vacuum countergravity casting of molten metal, comprising:

(a) a housing having a wall defining a chamber confronting a mold for receiving molten metal, (b) said mold comprising (1) a gas permeable upper mold member having an upper surface and at least in part defining a mold cavity, and (2) a lower mold member engaged to the upper mold member and having a bottom ingate passage for supplying molten metal to the mold cavity from an underlying molten metal pool subjected to ambient pressure, (c) said housing having a septum in said chamber, said septum having (1) a peripheral portion secured on said wall and (2) a central portion bounded by said peripheral portion, said central portion overlying the upper surface of the upper mold member and contacting the upper surface to transmit ambient pressure to the upper mold member, and (d) means for providing subambient pressure between said septum and said upper mold member to draw molten metal into the mold cavity through the ingate passage when said lower mold member is placed in the molten metal, whereby ambient pressure is transmitted by said septum to the upper mold member in opposition to the ambient pressure transmitted to the lower mold member so as to minimize bending stresses in the mold.

2. The apparatus of claim 1 wherein said septum is gas impermeable.

3. The apparatus of claim 2 further including means for providing ambient pressure in the housing above the septum, said septum transmitting the ambient pressure thereabove in the housing to the upper mold member.

4. The apparatus of claim 1 wherein said septum is gas permeable and rigid.

5. The apparatus of claim 4 further including means for providing subambient pressure in the housing above the septum.

6. The apparatus of claim 5 further including means for providing ambient pressure on the outside of the housing, said septum transmitting the ambient pressure on the housing to said upper mold member.

7. The apparatus of claim 6 wherein the housing includes a relatively movable upper portion and lower portion, said septum being secured to the upper portion of said housing and said mold being sealed to the lower portion of the housing.

8. The apparatus of claim 7 wherein the housing includes a flexible sealing joint between the upper portion and lower portion thereof.

9. The apparatus of claim 1 wherein the upper mold member and lower mold member are held together when the subambient pressure is provided between the septum and the upper mold member solely by the ambient pressure exerted by said septum on the upper mold member and the ambient pressure exerted on the lower mold member in opposition to one another.

10. An apparatus for vacuum countergravity casting of molten metal comprising:

(a) a mold comprising a gas permeable upper mold member having an upper surface and at least in part defining a mold cavity and a lower mold member engaged to the upper mold member and having a bottom ingate passage for supplying molten metal to the mold cavity from an underlying container of molten metal subjected to ambient pressure, (b) a gas impermeable member having a portion overlying the upper surface of the upper mold member and in contact with the upper surface at a plurality of spaced apart contact regions distributed across the upper surface and having a peripheral portion, (c) sealing means disposed between the peripheral portion and the mold, (d) means for providing ambient pressure above said gas impermeable member, and (e) means for providing subambient pressure between said gas impermeable member and said upper mold member to draw molten metal into the mold cavity through the ingate passage when said lower mold member is placed in the molten metal, whereby ambient pressure above said gas impermeable member is transmitted by the plurality of contact regions to the upper mold member in opposition to ambient pressure transmitted to the lower mold member.

11. The apparatus of claim 10 wherein said sealing means is disposed between said peripheral portion and the upper mold member.

12. The apparatus of claim 10 wherein said sealing means is disposed between said peripheral portion and the lower mold member.

13. The apparatus of claim 10 wherein said means for providing said ambient pressure above said gas impermeable member comprises a housing to which the peripheral portion of the gas impermeable member is attached, said housing being vented to ambient pressure above said gas impermeable member.

14. The apparatus of claim 10 wherein said means for providing said subambient pressure comprises a vacuum conduit sealingly attached to said gas impermeable member.

15. The apparatus of claim 10 wherein the plurality of contact regions comprise a plurality of standoffs between said overlying portion of the gas impermeable member and said upper surface.

16. The apparatus of claim 10 wherein the gas impermeable member is a sheet metal member having a plurality of spaced apart standoffs extending toward the upper mold member for providing said contact regions and forming a space between the sheet metal member and upper mold member around the standoffs.

17. The apparatus of claim 10 wherein the gas impermeable member is a flexible membrane.

18. An apparatus for vacuum countergravity casting of molten metal comprising:

(a) a housing having a wall defining a chamber confronting a mold for receiving molten metal, (b) said mold comprising (1) a gas permeable upper mold member having an upper surface and at least in part defining a mold cavity, and (2) a lower mold member engaged to the upper mold member and having a bottom ingate passage for supplying molten metal to the mold cavity from an underlying container of molten metal subjected to ambient pressure, (c) a gas impermeable septum in said chamber, said septum having (1) a portion overlying the upper surface of the upper mold member and in contact with the upper surface at a plurality of spaced apart contact regions distributed across the upper surface and (2) a peripheral portion in sealed relation to the wall, (d) means for providing ambient pressure in the housing above said septum, and (e) means for providing subambient pressure between said septum and said upper mold member to draw molten metal into the mold cavity through the ingate passage when said lower mold member is placed in the molten metal, whereby the ambient pressure above said septum is transmitted by said contact regions to the upper mold member in opposition to the ambient pressure transmitted to the lower mold member so as to minimize bending stresses in the mold.

19. The apparatus of claim 18 wherein said wall is in sealed relation to the upper mold member.

20. The apparatus of claim 18 wherein said wall is in sealed relation to the lower mold member.

21. The apparatus of claim 18 wherein said ambient pressure is atmospheric pressure and said means for providing same above said septum is a vent in said housing.

22. The apparatus of claim 18 wherein said means for providing subambient pressure is a vacuum conduit sealingly attached to said septum.

23. The apparatus of claim 18 wherein said plurality of contact regions comprise a plurality of standoffs between said septum and said upper surface.

24. The apparatus of claim 18 wherein the septum comprises sheet metal having a plurality of spaced apart standoffs engaging the upper mold member for providing said contact regions and forming a space between the sheet metal and upper mold member around the standoffs.

25. The apparatus of claim 18 wherein the peripheral portion of said septum is flexibly attached to said wall to permit relative movement between said septum and said wall.

26. The apparatus of claim 25 wherein said wall includes a stop member adapted to be engaged by movement of said septum such that said septum carries said wall toward and away from said mold.

27. The apparatus of claim 26 wherein said stop member disengages from said septum when said wall sealingly engages said mold.

28. An apparatus for vacuum countergravity casting of molten metal comprising:

(a) a housing having a wall defining a chamber confronting a mold for receiving molten metal, (b) said mold comprising a gas permeable upper mold member having an upper surface and at least in part defining a mold cavity and a lower mold member engaged to the upper mold member and having a bottom ingate passage for supplying molten metal to the mold cavity from an underlying container of molten metal subjected to atmospheric pressure, (c) a gas impermeable septum having a portion overlying the upper surface of the upper mold member and in contact therewith at a plurality of spaced apart contact regions distributed across the upper surface and having a peripheral portion in sealed relation to the wall, (d) means for exposing said gas impermeable septum to atmospheric pressure in the housing above said septum, and (e) means for providing subatmospheric pressure between said gas impermeable septum and said upper mold member to draw molten metal into the mold cavity through the ingate passage when said lower mold member is placed in the molten metal, whereby atmospheric pressure above said septum is transmitted by the plurality of contact regions to the upper mold member in opposition to atmospheric pressure transmitted to the lower mold member.

29. The apparatus of claim 28 wherein the plurality of contact regions comprise a plurality of spaced apart standoffs between said overlying portion of the gas impermeable septum and said upper surface.

30. The apparatus of claim 28 wherein the mold is ceramic.

31. The apparatus of claim 30 wherein both the upper mold member and lower mold member are bonded sand.

32. The apparatus of claim 31 wherein the mold has a ratio of horizontal mold dimension to vertical mold dimension of 7:1 and greater.

33. An apparatus for vacuum countergravity casting of molten metal comprising:

(a) a container of molten metal subjected to atmospheric pressure, (b) a mold comprising a gas permeable bonded sand upper mold member having an upper surface and at least in part defining a mold cavity and a bonded sand lower mold member engaged to the upper mold member and having a bottom ingate passage for supplying molten metal to the mold cavity from the container of molten metal, (c) a gas impermeable member having a portion overlying the upper surface of the upper mold member and a peripheral portion, said overlying portion having one side facing said upper surface and an opposite side exposed to atmospheric pressure thereabove, (d) a plurality of spaced apart standoffs between said one side and said upper surface to provide a plurality of spaced apart contact regions therebetween distributed across said upper surface, (e) sealing means disposed between the peripheral portion and the mold, (f) a vacuum conduit connected at one end to said gas impermeable member and at another end to a source of reduced pressure for providing relatively reduced pressure beneath the gas impermeable member around the standoffs and on the upper mold member so as to draw molten metal into the mold cavity through the ingate passage when said lower mold member is placed in the molten metal, whereby atmospheric pressure on said overlying portion is transmitted by said standoffs to the upper mold member in opposition to atmospheric pressure transmitted to the lower mold member through the molten metal to substantially reduce bending stresses in the mold.

34. An apparatus for vacuum countergravity casting of molten metal comprising:

(a) a housing defining a vacuum chamber sealingly confronting a mold for receiving molten metal, said housing having an upper portion and a lower portion relatively movable to one another, (b) said mold comprising (1) a gas permeable upper mold member having an upper surface and at least in part defining a mold cavity, and (2) a lower mold member engaged to the upper mold member and having a bottom ingate passage for supplying molten metal to the mold cavity from an underlying molten metal pool subjected to ambient pressure, (c) said housing having a rigid, gas permeable septum in said vacuum chamber, said septum having (1) a portion overlying the upper surface of the upper mold member for contacting the upper surface to transmit ambient pressure on the housing to the upper mold member and to communicate said upper mold member to the vacuum chamber and (2) a peripheral portion secured on the upper portion of housing, (d) means for sealing the mold to the lower portion of the housing, (e) means for providing ambient pressure on said housing, and (f) means for providing subambient pressure in said vacuum chamber to evacuate the mold cavity through the gas permeable septum to draw molten metal into the mold cavity through the ingate passage when said lower mold member is placed in the molten metal, whereby, when subambient pressure is provided in said vacuum chamber, said mold and housing are relatively moved toward one another as permitted by relative movement between said upper portion and lower portion so as to contact said septum and said upper mold member for transmitting the ambient pressure on said housing to the upper mold member in opposition to the ambient pressure transmitted to the lower mold member to minimize bending stresses in the mold.

35. The apparatus of claim 34 including a flexible sealing joint between the upper portion and lower portion of the housing.

36. In vacuum countergravity casting molten metal into a mold having a gas permeable upper mold member and a lower mold member engaged together, the steps of:

(a) enclosing the upper mold member in a chamber having a septum therein overlying the upper mold member for contacting the upper mold member, and (b) applying subambient pressure between the septum and the upper mold member to evacuate a mold cavity at least in part defined in the upper mold member to draw molten metal from an underlying molten metal pool into said mold cavity, including transmitting ambient pressure to the upper mold member by contact with said septum in opposition to ambient pressure transmitted to the lower mold member to minimize bending stresses in the mold.

37. In vacuum countergravity casting molten metal into a mold having a gas permeable upper mold member and a lower mold member engaged together, the steps of:

(a) overlaying a gas impermeable member on the upper mold member including contacting the gas impermeable member and upper surface of the upper mold member at a plurality of spaced apart contact regions distributed across the upper surface and peripherally sealing the gas impermeable member substantially about the upper mold member, and (b) applying a reduced pressure between the gas impermeable member and the upper mold member to fill a mold cavity at least in part defined therein with molten metal from an underlying molten metal pool and transmitting through said contact regions ambient pressure above the gas impermeable member to the upper mold member in opposition to ambient pressure transmitted to the lower mold member.

38. In vacuum countergravity casting molten metal into a mold having a gas permeable upper mold member and a lower mold member engaged together, the steps of:

(a) overlaying a gas impermeable member on the upper mold member including contacting the gas impermeable member and upper surface of the upper mold member at a plurality of spaced apart contact regions distributed across the upper surface and peripherally sealing the gas impermeable member substantially about the upper mold member, and (b) applying a reduced pressure between the gas impermeable member and the upper mold member to fill a mold cavity at least in part defined therein with molten metal from an underlying molten metal pool and transmitting through said contact regions atmospheric pressure above the gas impermeable member to the upper mold member in opposition to atmospheric pressure transmitted to the lower mold member.

39. The casting method of claim 38 wherein said upper mold member and lower mold member are held together solely by the opposing ambient pressure transmitted thereto.

40. In vacuum countergravity casting molten metal into a mold having a gas permeable upper mold member and a lower mold member engaged together, the steps of:

(a) overlaying a gas impermeable member on the upper mold member including contacting the gas impermeable member and upper surface of the upper mold member at a plurality of spaced apart contact regions distributed across the upper surface and peripherally sealing the gas impermeable member to the mold, and (b) applying a reduced pressure between the gas impermeable member and the upper mold member to fill a mold cavity at least in part defined therein with molten metal from an underlying molten metal pool and transmitting through said contact regions atmospheric pressure above the gas impermeable member to the upper mold member in opposition to atmospheric pressure transmitted to the lower mold member.

41. The casting method of claim 40 wherein said upper mold member and lower mold member are held together solely by the opposing ambient pressure transmitted thereto.

42. In vacuum countergravity casting molten metal into a mold having a gas permeable bonded sand upper mold member and bonded sand lower mold member engaged together, the improvement for reducing damage to the mold during casting comprising the steps of:

(a) overlaying a gas impermeable member on the upper mold member including contacting the gas impermeable member and upper surface of the upper mold member at a plurality of spaced apart contact regions distributed across the horizontal dimension of the upper surface and peripherally sealing the gas impermeable member to the mold, and (b) applying a reduced pressure between the gas impermeable member and the upper mold member to fill a mold cavity at least in part defined therein with molten metal from an underlying molten metal pool and concurrently transmitting through said contact regions atmospheric pressure above the gas impermeable member to the upper mold member in opposition to atmospheric pressure transmitted to the lower mold member to substantially reduce bending stresses in the mold.

43. The casting method of claim 42 wherein said upper mold member and lower mold member are held together solely by the opposing ambient pressure transmitted thereto.

44. In vacuum countergravity casting molten metal into a mold having a gas permeable upper mold member and a lower mold member engaged together, the steps of:

(a) enclosing the upper mold member in a vacuum chamber having a gas permeable septum secured therein and overlying the upper mold member for contacting an upper surface on the upper mold member when the vacuum chamber is evacuated, (b) sealing the lower mold member to the housing, and (c) applying subambient pressure in the vacuum chamber to evacuate a mold cavity at least in part defined in the upper mold member through said gas permeable septum to draw molten metal from an underlying molten metal pool into said mold cavity, including transmitting through said septum ambient pressure on the housing to the upper mold member in opposition to ambient pressure transmitted to the lower mold member.

45. The casting method of claim 44 including holding the upper mold member and lower mold member together solely by the ambient pressure transmitted to the upper mold member and the lower mold member.

46. The casting method of claim 44 including relatively moving the septum and the mold when the vacuum chamber is evacuated to effect contact between the septum and the upper mold member.

47. The casting method of claim 46 including attaching the septum to an upper portion of the housing and sealing the lower mold member to a lower portion of the housing, said upper portion and lower portion being relatively movable.

48. The casting method of claim 47 including flexibly, sealingly connecting said upper portion and lower portion of the housing to permit relative movement therebetween as the septum and the mold are relatively moved.

49. In a vacuum countergravity method for casting molten metal into a mold having a gas permeable upper mold member and a lower mold member engaged together wherein the mold is sealingly engaged to a chamber, the steps of:

(a) relatively movably interconnecting a gas impermeable member and a peripheral wall disposed around the gas impermeable member to form said chamber, (b) releasably engaging said gas impermeable member and said peripheral wall, and (c) relatively moving the mold and the gas impermeable member with the peripheral wall releasably engaged thereto to engage the peripheral wall in sealing relation to the mold, and (d) continuing relative movement between the mold and the gas impermeable member to disengage the gas impermeable member and the peripheral wall and contact said gas impermeable member with said upper mold member.

50. The method of claim 49 including relatively moving the gas impermeable member and the mold to disengage the gas impermeable member from said upper mold member.

51. The method of claim 50 including releasably engaging the gas impermeable member and the peripheral wall after the gas impermeable member disenages from said upper mold member so as to disengage said peripheral wall and said mold from their sealing relation.

52. The method of claim 49 wherein a peripheral portion of the gas impermeable member releasably engages with an upwardly extending stop member on the peripheral wall.

53. The method of claim 49 wherein the peripheral wall is placed in sealing relation to the lower mold member.

* * * * *

UNITED STATES PATENT AND TRADEMARK OFFICE

CERTIFICATE OF CORRECTION

PATENT NO. : 4,858,672

DATED : August 22, 1989

INVENTOR(S) : George D. Chandley

It is certified that error appears in the above-identified patent and that said Letters Patent is hereby corrected as shown below:

Column 5, line 10, delete "Various" and insert --various--. Column 9, line 16, after "molten" insert --metal--. Column 9, line 34, after "component" insert --.--. Column 18, line 58, delete "disenages" insert --disengages--.

Signed and Sealed this

Thirteenth Day of November, 1990

*Attest:*

HARRY F. MANBECK, JR.

*Attesting Officer*

*Commissioner of Patents and Trademarks*